US007123207B2

(12) United States Patent
Yazdandoost et al.

(10) Patent No.: US 7,123,207 B2
(45) Date of Patent: Oct. 17, 2006

(54) ULTRA WIDEBAND BOW-TIE PRINTED ANTENNA

(75) Inventors: Kamya Yekeh Yazdandoost, Tokyo (JP); Ryuji Kohno, Tokyo (JP)

(73) Assignee: National Institute of Information and Communications Technology, Koganei (JP)

( * ) Notice: Subject to any disclaimer, the term of this patent is extended or adjusted under 35 U.S.C. 154(b) by 0 days.

(21) Appl. No.: 10/925,926

(22) Filed: Aug. 26, 2004

(65) Prior Publication Data

US 2005/0146480 A1 Jul. 7, 2005

(30) Foreign Application Priority Data

Sep. 9, 2003 (JP) ..... 2003-317160

(51) Int. Cl.
*H01Q 9/28* (2006.01)

(52) U.S. Cl. ..... 343/795; 343/700 MS; 343/822

(58) Field of Classification Search ..... 343/700 MS, 343/795, 797, 850, 853, 820, 821, 822, 793, 343/860
See application file for complete search history.

(56) References Cited

U.S. PATENT DOCUMENTS

| | | | | |
|---|---|---|---|---|
| 2,935,747 | A | 5/1960 | Ghose | 343/767 |
| 4,495,505 | A | 1/1985 | Shields | |
| 4,607,394 | A * | 8/1986 | Nightingale | 455/327 |
| 6,211,840 | B1 * | 4/2001 | Wood et al. | 343/793 |
| 6,307,525 | B1 * | 10/2001 | Bateman et al. | 343/853 |
| 6,342,866 | B1 | 1/2002 | Ho et al. | |
| 6,975,278 | B1 * | 12/2005 | Song et al. | 343/795 |

FOREIGN PATENT DOCUMENTS

| | | | |
|---|---|---|---|
| EP | 1 229 605 | A1 | 8/2002 |
| JP | 04-200003 | | 7/1992 |
| JP | 54-96554 | | 7/1992 |
| JP | 06-303010 | A | 10/1994 |
| JP | 7-106841 | | 4/1995 |
| JP | 2829378 | B2 | 2/1997 |
| JP | 09-246817 | A | 9/1997 |
| JP | 10-293174 | A | 11/1998 |
| JP | 10-335910 | A | 12/1998 |
| JP | 2001-185942 | | 7/2001 |
| JP | 2001-345608 | A | 12/2001 |
| JP | 2002-111208 | A | 4/2002 |
| JP | 2002-135037 | A | 5/2002 |
| JP | 2003-78345 | A | 3/2003 |

(Continued)

OTHER PUBLICATIONS

G. Kumar et al., "Directly Coupled Multiple Resonator Wide-Band Microstrip Antennas," IEEE Trans. Antennas Propagation, vol. 33, pp. 588-593, Jun. 1985.

(Continued)

*Primary Examiner*—Hoanganh Le

(57) ABSTRACT

A printed antenna includes a dielectric substrate having a pair of printed antenna elements to form a dipole antenna. On an antenna plane, an xy axis system is defined so that an origin is defined at a center of location of the antenna elements, and an x axis is set in a direction that the antenna elements are arranged, a y axis is set in the direction perpendicular to the x axis, and a size of the antenna elements in the direction of the y axis become gradually larger according to the x axis changing in an outer direction. Each of the antenna elements has an impedance matching part at a feeding side of the antenna elements. The printed antenna can be used in an ultra wide-band frequency, and is small profile, is light weight and low in cost.

10 Claims, 14 Drawing Sheets

FOREIGN PATENT DOCUMENTS

| | | | |
|---|---|---|---|
| JP | 2003-087045 | | 3/2003 |
| JP | 3502945 | B2 | 4/2003 |
| JP | 2003-174315 | A | 6/2003 |
| JP | 2003-283241 | A | 10/2003 |
| WO | WO 99/57697 | | 11/1999 |

OTHER PUBLICATIONS

K. L. Wong et al., "Broadband triangular microstrip antenna with U-shaped slot," Elec. Lett., vol. 33, pp. 2085-2087, 1997.

F. Yang et al., "Wide-Band E-Shaped Patch Antenna for Wireless Communications," IEEE Trans. Antennas Propagation, vol. 49, pp. 1094-1100, Jul. 2001.

A. K. Shackelford et al., "Design of Small-Size Side-Bandwidth Microstrip-Patch Antennas," IEEE Antennas Propagation Magz., vol. 45, pp. 75-83, Feb. 2003.

J. Y. Chiou et al., "A Broad-Band CPW-Fed Strip-Loaded Square Slot Antenna," IEEE Trans. Antennas Propagation, vol. 51, pp. 719-721, Apr. 2003.

N. Herscovici et al., "Circularly Polarized Single-Fed Wide-Band Microstrip Patch," IEEE Trans. Antennas Propagation, vol. 51, pp. 1277-1280, Jun. 2003.

Sadahiko Yamamoto et al., *Coupled Nonuniform Transmission Line and Its Applications*, IEEE Transactions on Microwave Theory and Techniques, vol. MTT-15, No. 4, Apr. 1967, pp. 220-231.

U.S. Appl. No. 11/023,454, filed Dec. 29, 2004, Yazdandoost et al.

D. Mirshekar-Syahkal and D. Wake, "Bow-tie antennas on high dielectric substrates for MMIC and OEIC applications at millimetre-wave frequencies", IEEE Journals, Electronics Letters, vol. 31, Issue 24, Nov. 23, 1995, pp. 2060-2061.

E. A. Soliman et al., "Bow-tie slot antenna fed by CPW", IEEE Journals, Electronics Letters, vol. 35, Issue 7, Apr. 1, 1999, pp. 514-515.

* cited by examiner 3.1GHz $\phi$=0°

3.1GHz $\phi$=90°

5.1GHz $\phi=0°$ 5.1GHz $\phi=90°$ 7.1GHz $\phi$=0°

7.1GHz $\phi$=90°

9.1GHz $\phi$=0°

9.1GHz $\phi$=90°

ULTRA WIDEBAND BOW-TIE PRINTED ANTENNA

CROSS-REFERENCE TO RELATED APPLICATIONS

This application claims priority to Japanese Patent Application No. 2003-317160, filed Sep. 9, 2003 in Japan, the contents of which are incorporated herein by reference.

BACKGROUND OF THE INVENTION

1. Field of the Invention

The present invention relates to a printed antenna, which has an ultra wide-band ("UWB") frequency range. The ultra wideband antenna is loaded on UWB wireless devices for its use. Therefore, it is required to be low and small profile, light weight and low cost. Moreover, the characteristics of ultra wideband antenna have to be constant gain and omni-directional patterns.

2. Description of the Related Art

Growing use of wireless communication devices has forced the need of large bandwidth, and large bit-rates, such as bit-rates of several hundred Mbps. It requires an antenna having excellent characteristics in the range of ultra wide-band frequency. Further the antenna has to be small profile, light weight and low cost.

FIG. 14A and FIG. 14B show a prior art of an example of wide frequency band patch antenna, that is a bow-tie type patch antenna. FIG. 14A shows a cross sectional view of the antenna, and FIG. 14B shows a top view of same. In FIG. 14A and FIG. 14B, a substrate 20 is composed of dielectric material such as FR4. A patch 21 has a figure like a bow-tie. The patch 21 is made of metal as copper. A ground plate 22 of copper is provided on the back surface of the substrate. The patch 21 is connected to a line of coaxial cable which penetrates through the substrate 20. The shield of the coaxial line is connected to the ground plate 22.

The prior art of a printed bow-tie type antenna shown in FIG. 14A and FIG. 14B does not have the wide frequency range such as the ultra wide frequency, thus it is unsuitable to cover the ultra wideband frequency range. Several designs to make the patch antenna wide band have been reported, such as noted below in references 1–6. Their frequency range, however, is not be able to cover the ultra wideband communication frequency range of 3.1–10.6 GHz.

As mentioned above the prior art printed antenna have not satisfied the practical use of the ultra wideband communication devices so far. Because it is very difficult to make the wideband printed antenna having good frequency characteristics of the ultra wideband communication.

The following are references to the related art:

1. G. Kumar and K. C. Gupta, "Directly coupled multi resonator wide-band microstrip antenna," IEEE Trans. Antennas Propagation, vol. 33, pp. 588–593, June 1985.

2. K. L. Wong and W. S. Hsu, "Broadband triangular microstrip antenna with U-shaped slot," Elec. Lett., vol. 33, pp. 2085–2087, 1997.

3. F. Yang, X. X. Zhang, X. Ye, Y Rahmat-Samii, "Wide-band E-shaped patch antenna for wireless communication," IEEE Trans. Antennas Propagation, vol. 49, pp. 1094–1100, July 2001.

4. A. K. Shackelford, K. F. Lee, and K. M. Luk, "Design of small-size wide-bandwidth microstrip-patch antenna," IEEE Antennas Propagation Magz., vol. 44, pp. 75–83, February 2003.

5. J. Y Chiou, J. Y. Sze, K. L. Wong, "A broad-band CPW-fed strip-loaded square slot antenna," IEEE Trans. Antennas Propagation, vol. 51, pp. 719–721, April 2003.

6. N. Herscovici, Z. Sipus, and D. Bonefacic, "Circularly polarized single-fed wide-band microstrip patch," IEEE Trans. Antennas Propagation, vol. 51, pp. 1277–1280, June 2003.

SUMMARY OF THE INVENTION

The present invention has as an object to provide an ultra wideband printed antenna, which is small in profile and light weight and has wide potential use for UWB portable wireless devices. The present invention relates to a printed antenna that is a new type of dipole antenna, which has impedance matching portion connected to strip lines and covers the ultra wide frequency band range. The dipole antenna is printed on a dielectric substrate, so that it is small profile, light weight, easy to fabricate and low cost.

That is, the printed antenna comprises a substrate of dielectric and a pair of antenna elements on the substrate. The antenna elements are set separately and adjacently on the substrate. On the antenna plane, an xy axis system is defined, wherein its origin is defined at a center of location of the antenna elements. The x axis is defined in the direction that the antenna elements are arranged on the x axis, and y axis is perpendicular to the x axis. The size of the antenna elements in the direction of y axis becomes gradually larger toward the outer portion on the x axis. Further, there are impedance matching parts and each impedance matching part is formed to each antenna element with one body at their sides to strip lines.

The VSWR characteristic of the antenna according to aspects of the present invention is under 3 in a frequency range from 3.1 GHz to 10.6 GHz, and the other frequency characteristic, like gain, etc. is good in the range of a wide frequency of 3.1 GHz to 10.6 GHz, and is an omni-direction pattern in the frequency range. Because of these features, the ultra wideband antenna of the present invention can be used for devices of an ultra wideband communication system from 3.01 GHz to 10.6 GHz. The antenna profile, moreover, is a very small size, such as a length of 16 mm, a width of 40 mm, and a thickness of 0.5 mm, very light weight, easy to fabricate and low-cost. The present invention has as further object to create a fine effect for practical use and its fabrication.

BRIEF DESCRIPTION OF THE DRAWINGS

The objects, advantages and features of the present invention will be more clearly understood by referencing the following detailed disclosure and the accompanying drawings.

DETAILED DESCRIPTION OF THE PREFERRED EMBODIMENTS

Figure 1A:
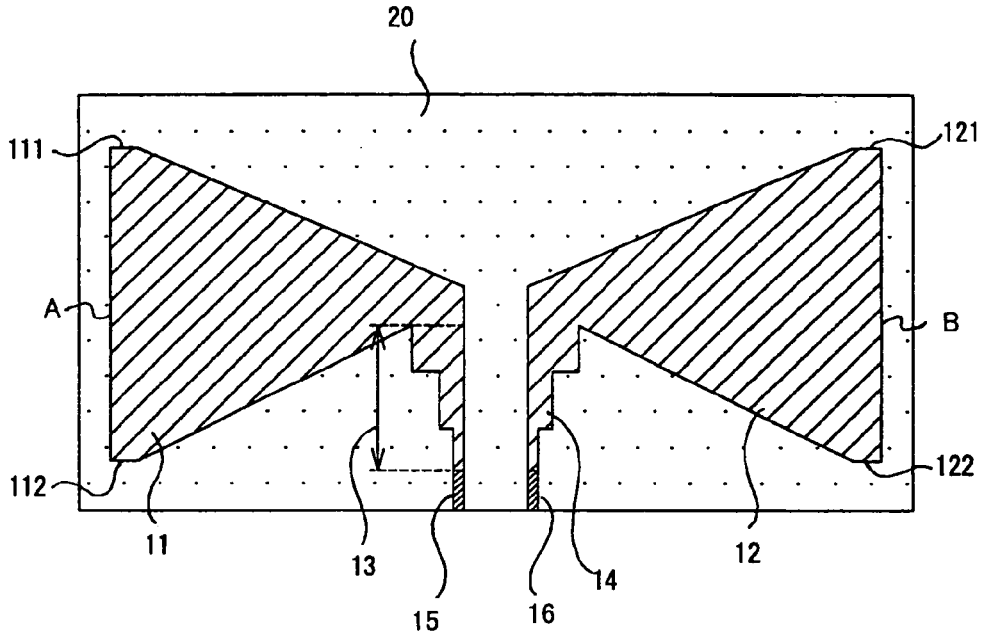
FIG. 1A is an explanation drawing of a plain view of an embodiment of an antenna according to the present invention.
Figure 1B:
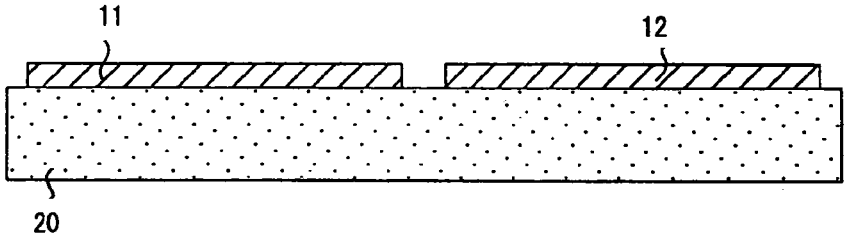
FIG. 1B is an explanation drawing of a cross-sectional view of the embodiment of the antenna according to the present invention.
Figure 14A:
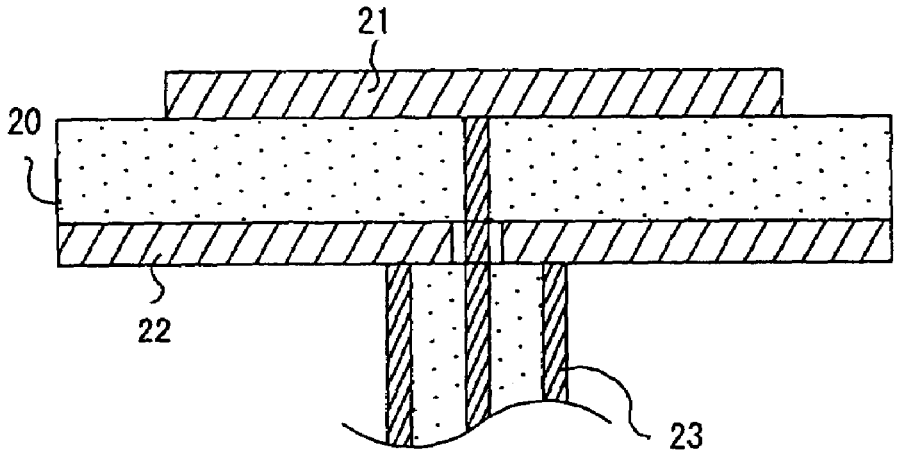
FIG. 14 A PRIOR ART
FIG. 14A is a plain view drawing of a prior art bow-tie type patch antenna.
Figure 14B:
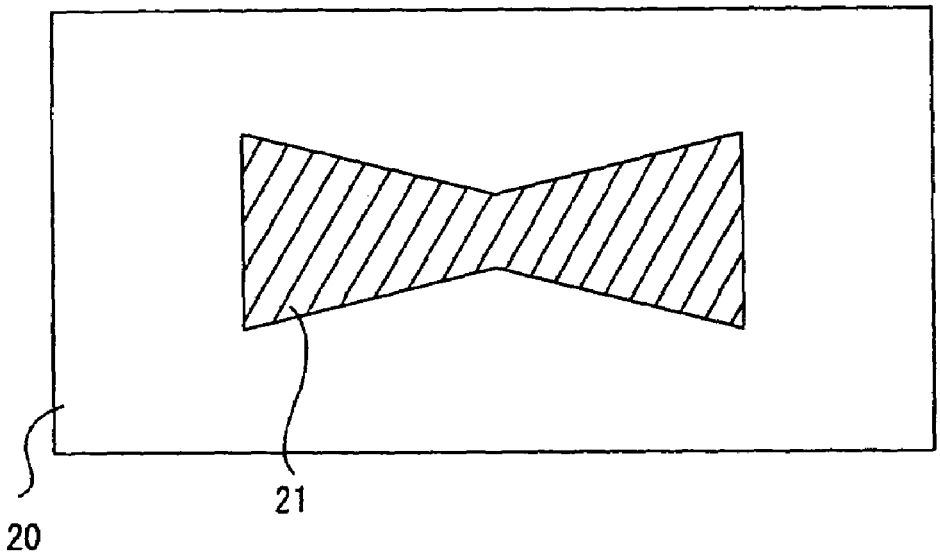
FIG. 14 B PRIOR ART
FIG. 14B is a cross sectional view of a prior art bow-tie type patch antenna.

FIG. 1A and FIG. 1B show an ultra wideband printed antenna according to a preferred embodiment of the present invention. Each of antenna elements 11, 12 is the same size, and a pair of the antenna elements makes a bow-tie shape. They are printed on a thin substrate of 0.5 mm made with the relative permittivity of $\epsilon_r$=4.4. The printed antenna according to the preferred embodiment of the present invention is a kind of dipole antenna, which is different from the bow-tie type patch antenna shown in FIG. 14A and FIG. 14B. Moreover impedance matching portions are formed between the antenna elements and strip lines. The printed antenna according to the preferred embodiment of the present invention is fed through a co-planar strip line of 75Ω for example.

In the following embodiment, substrate 20 is made of FR4, and the printed pattern comprising antenna elements 11, 12 and impedance matching parts 13, 14 are made of copper. Insulation materials, such as Silicon (Si) or Teflon, other than FR4, however also can be used for the substrate 20. Electric conductive metal, such as Al, Ag, Au, other than copper, also can be used for the printed pattern of antenna elements 11, 12 and impedance matching parts 13, 14.

Figure 1C:
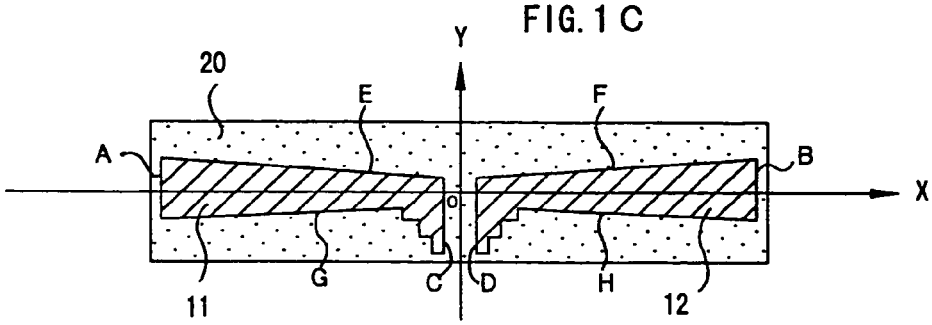
FIG. 1C is an explanatory drawing of an xy axis system defined on the antenna plane of the embodiment of an antenna according to the present invention.

FIG. 1A is a top view of an antenna according to an embodiment of the present invention and FIG. 1B shows a cross-sectional view of the antenna. FIG. 1C shows a xy axis system defined on the antenna plane of an antenna according to the embodiment of the invention.

The antenna pattern in FIG. 1A is made, for example, by photo etching a copper plate formed on the substrate. A pair of right and left side patterns of antenna elements 11, 12 and impedance matching parts 13, 14 make a figure like a bow-tie. The impedance matching portions 13, 14 are formed as one body with each antenna element 11, 12 at their sides of strip lines 15 and 16.

Each antenna element 11, 12 shown in FIG. 1A comprises small cut portions 111, 112, 121 and 122, which are cut in a direction parallel to the x axis at the ends of the sides A and B. Making the cut portions shortens the antenna length along the y axis, and improves a VSWR characteristic of the antenna.

FIG. 1C shows the xy axis system defined on the surface of the printed antenna according to the embodiment of the invention. On the antenna plane, the xy axis system is defined as shown in FIG. 1C. The origin xy axis is set at a center of the gap between the antenna elements 11 and 12, the x axis is set in the direction along two antenna elements, and the y axis is set perpendicular to the x axis. Each side of the antenna elements is defined to be sides A, B, C, D, E, F, G and H as shown in FIGS. 1C and 2B.

Figure 2A:
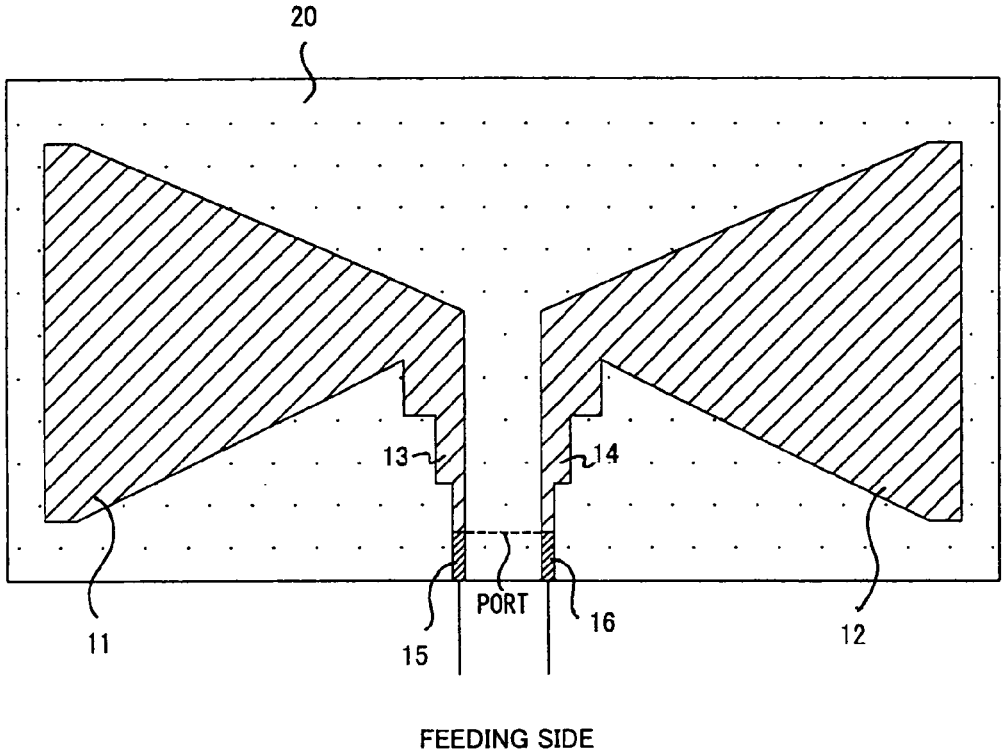
FIG. 2A is another explanatory drawing of a plain view of the embodiment of an antenna according to the present invention.

FIG. 2A is an explanatory drawing of a power feeding of the printed antenna according to an embodiment of the present invention. The antenna elements 11, 12 are driven by power fed through the impedance matching portion 13, 14 from a feeding side as shown.

Figure 2B:
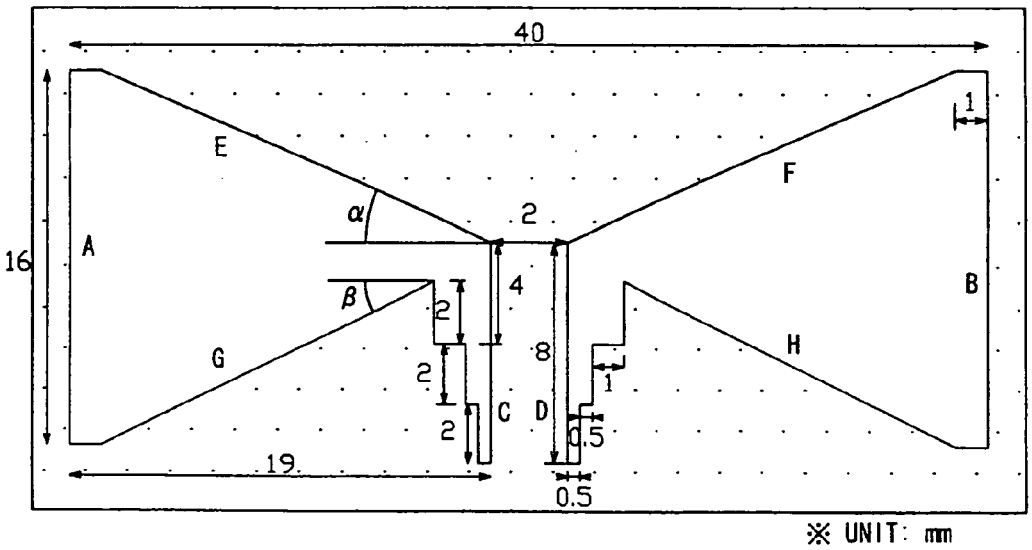
FIG. 2B is another explanatory drawing of a plain view of the embodiment of an antenna according to the present invention.

FIG. 2B shows an example of a size of the printed antenna according to an embodiment of the present invention. The antenna width that is the distance between sides A and B is 40 mm, and the antenna length that is the length of side A and B is 16 mm. The sides A and B are parallel to each other. The gap distance between sides C and D is 2 mm, and the sides C and D are parallel to each other. The distance between sides A and side C is 19 mm. Each length of the cut portions of the ends of sides A and B is 1 mm, and parallel to each other. Angle α i.e., the angle of side E from x axis and the angle of side F from x axis, is 23.96° and β that is the angle of side G from x axis and the angle of side H from x axis, is 20.55°. The thickness of the substrate h is 0.5 mm. The impedance matching parts 13 and 14 in FIGS. 2A and 2B are narrowed by three steps with the size in FIG. 2B, and the impedance matching portion is connected to the strip lines 15 and 16.

The printed antenna according to an embodiment of the present invention is made using a plate comprising a substrate of FR 4 and a copper plate layered on the substrate. The antenna patterns comprising the antenna elements and the impedance matching portions are made by photo-etching the copper plate, for example, a layer of photo-resist film is formed on the copper plate by painting photo-resist. Next the painted photo-resist layer is exposed to light through a photo-mask, which has the pattern of the antenna elements and the impedance matching portions. The photo-resist film is soaked in solution to dissolve the unlighted portion. The lighted portion of the photo-resist layer is left on the copper plate. The left portion of the exposed photo-resist layer on the copper is used for an etching mask to etch the copper layer. Further the whole plate is soaked in etching liquid and etches the copper plate with the etching musk of photo-resist. Thus the antenna pattern of copper of the antenna elements and the impedance parts are united each as one body and formed on the substrate.

FIGS. 3–13 show the characteristics of the above mentioned printed antenna according to the embodiment of the invention. The antenna characteristics are analyzed by a simulator of the title "ANSOFT ENSEMBLE".

Figure 3:
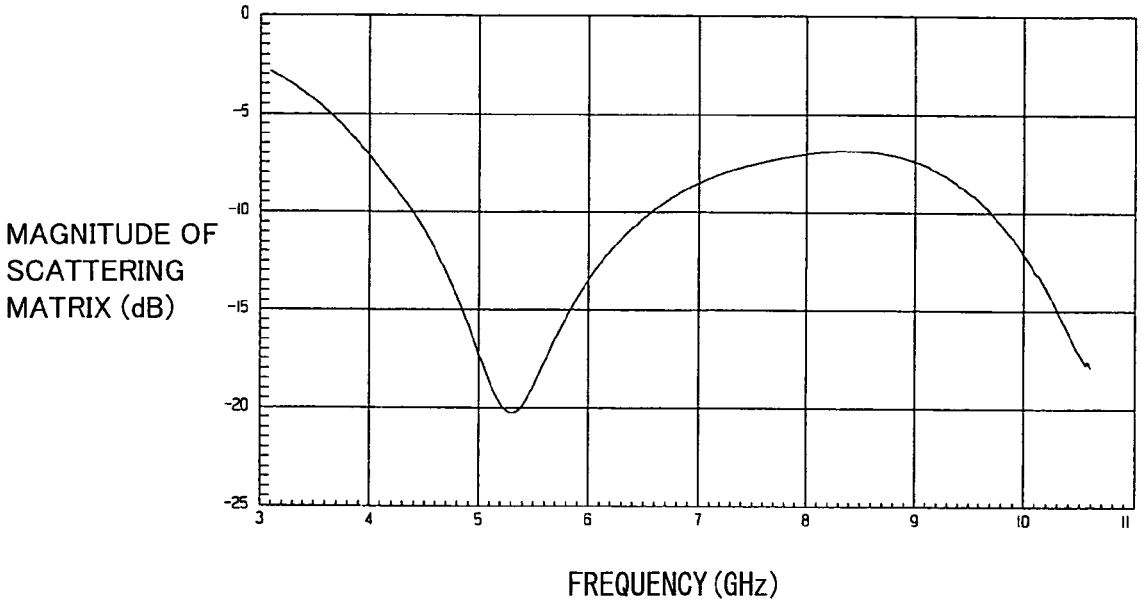
FIG. 3 is a graph of frequency characteristics of return loss of the embodiment of a printed antenna according to the present invention.

FIG. 3 shows scattering characteristics of an S11 matrix, that is frequency characteristic of return loss, in the frequency rage of 3.1–10.6 GHz. FIG. 3 shows that the return loss is under −6 dB in a range from 3.1 GHz to 10.6 GHz. It shows that the printed antenna according to the embodiment of the present invention has excellent ultra wide range characteristics.

Figure 4:
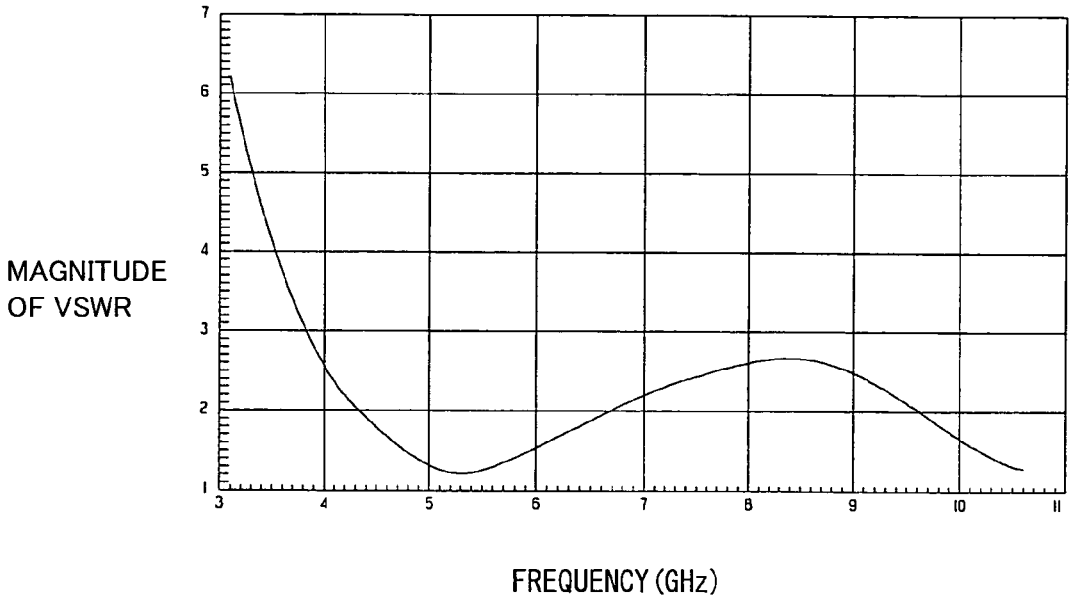
FIG. 4 is a graph of frequency characteristic of VSWR of the embodiment of a printed antenna according to the present invention.

FIG. 4 is a graph showing a frequency characteristic of VSWR (Voltage Standing Wave Ratio) of the frequency characteristic of the antenna, that is magnitude of VSWR vs. frequency. FIG. 4 shows that the VSWR is about 2.5–3 in a range from 3.1 GHz to 10.6 GHz. It shows that the antenna according to the embodiment of the present invention has excellent VSWR characteristic in the frequency range of ultra wide band.

Figure 5:
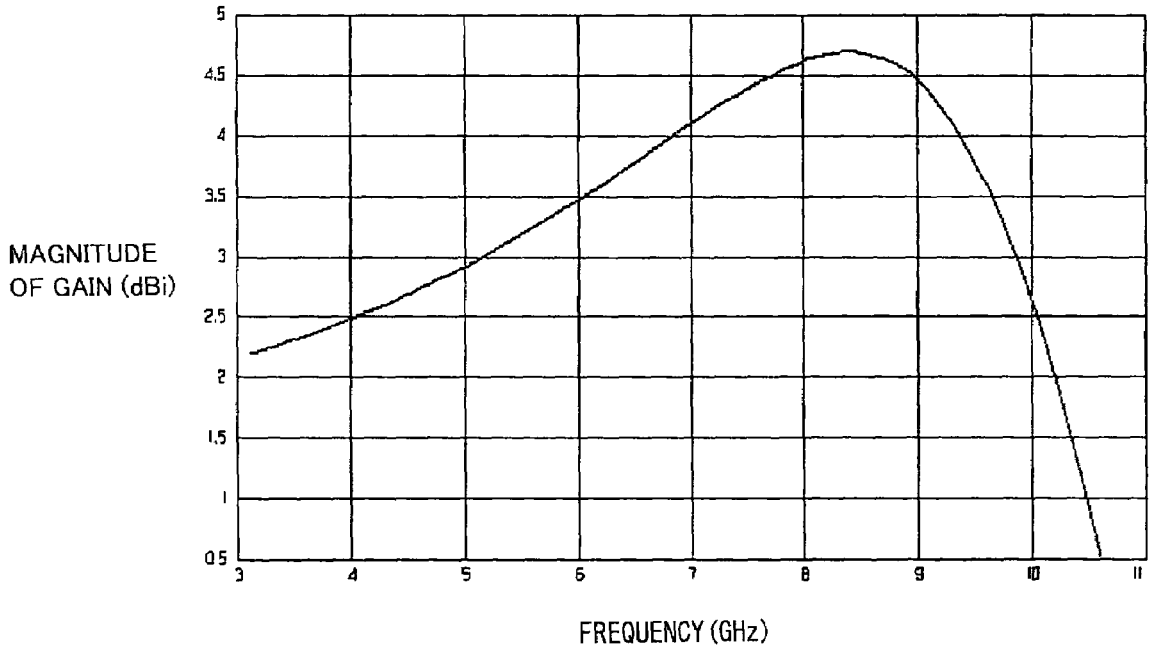
FIG. 5 is a graph of frequency characteristics of antenna gain of the embodiment of a printed antenna according to the present invention.

FIG. 5 is a graph showing a frequency characteristic of antenna gain that is magnitude of gain vs. frequency. The printed antenna according to the embodiment of the present invention has a gain 2.5 dBi in a frequency range of 3.1 GHz–10.6 GHz, and the maximum gain is 4.7 dBi.

Figure 6:
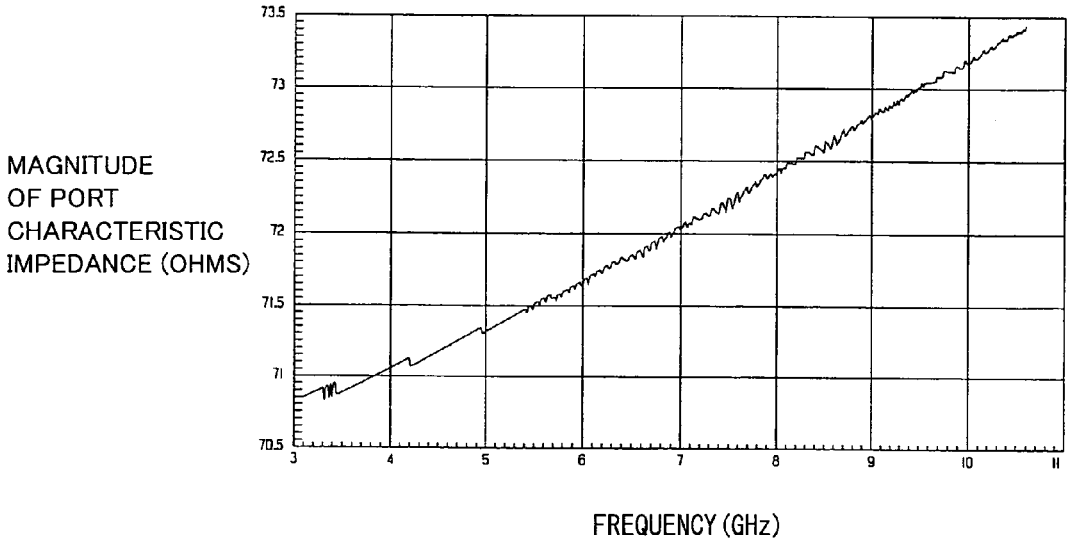
FIG. 6 is a graph of frequency characteristics of characteristic impedance of the embodiment of a printed antenna according to the present invention.

FIG. 6 is a graph showing a frequency characteristic of characteristic impedance at the port (see FIG. 2A) in a frequency range from 3.1 GHz to 10.6 GHz, that is magnitude of port characteristic impedance vs. frequency. The characteristic impedance is about from 71 Ω to 73Ω, that is the fluctuation of 2Ω. FIG. 6 shows that the characteristic impedance is kept almost constant in the frequency range.

Figure 7:
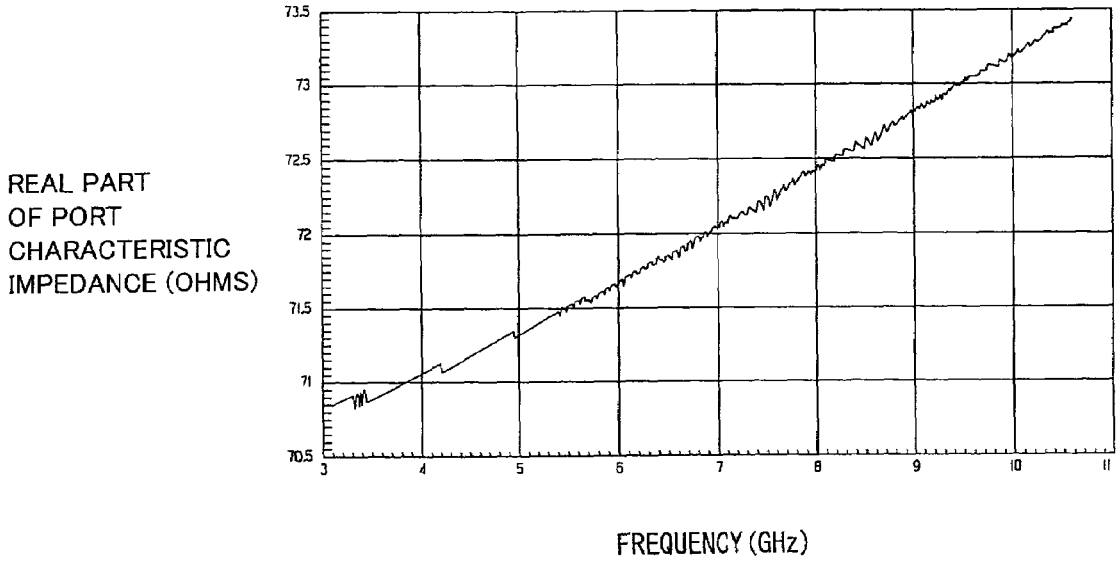
FIG. 7 is a graph of frequency characteristic of a real part of characteristic impedance of the embodiment of a printed antenna according to the present invention.

FIG. 7 is a graph showing a frequency characteristic of a real part of characteristic impedance at the port in the frequency range of 3.1 GHz to 10.6 GHz. The real part of characteristic impedance is about from 71 Ω to 73Ω that is the fluctuation of 2 Ω. FIG. 7 shows that the real part of the characteristic impedance is kept almost constant in the frequency range.

Figure 8:
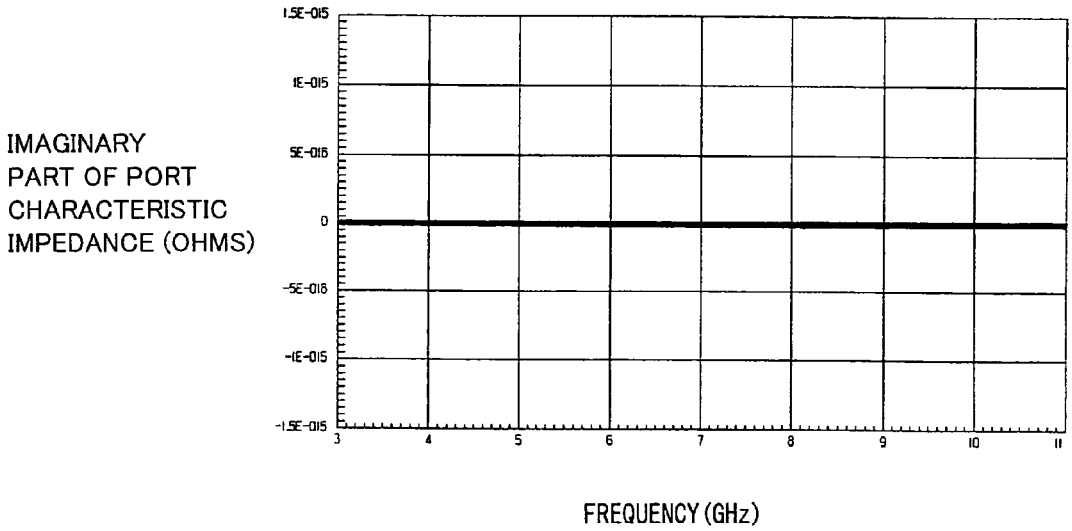
FIG. 8 is a graph of frequency characteristic of an imaginary part of characteristic impedance of the embodiment of a printed antenna according to the present invention.

FIG. 8 is a graph showing a frequency characteristic of an imaginary part of the characteristic impedance at the port in the frequency of 3.1 GHz to 10.6 GHz. The imaginary part is about 0Ω in the frequency range.

Figure 9:
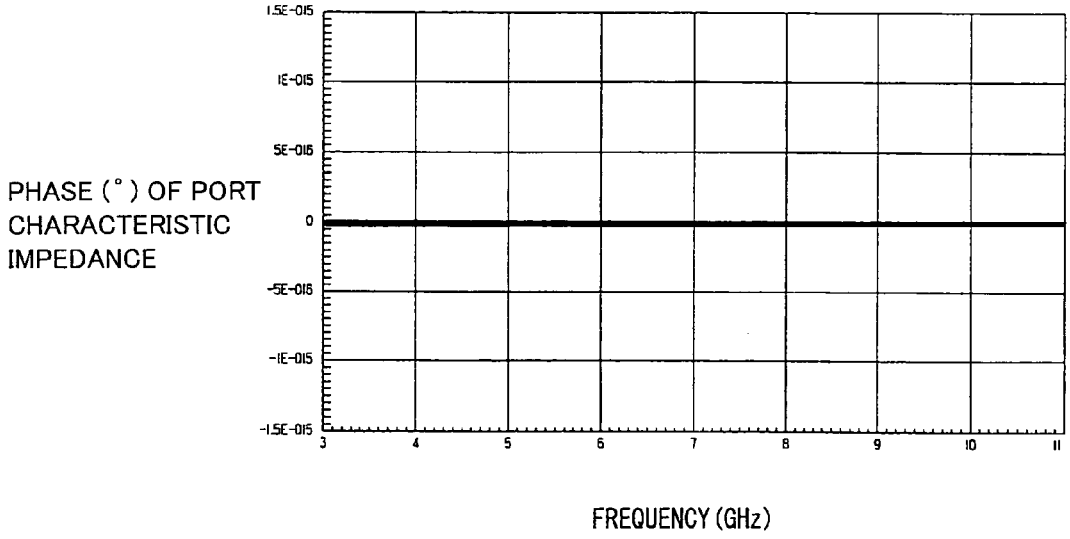
FIG. 9 is a graph of frequency characteristic of phase of characteristic impedance of the embodiment of a printed antenna according to the present invention.

FIG. 9 is a graph showing a frequency characteristic of phase of characteristic impedance at the port in the frequency range from 3.1 GHz to 10.6 GHz, that is phase (°) of port characteristic impedance vs. frequency. FIG. 9 shows the phase is constant in the frequency range from 3.1 GHz to 10.6 GHz.

Figure 10A:
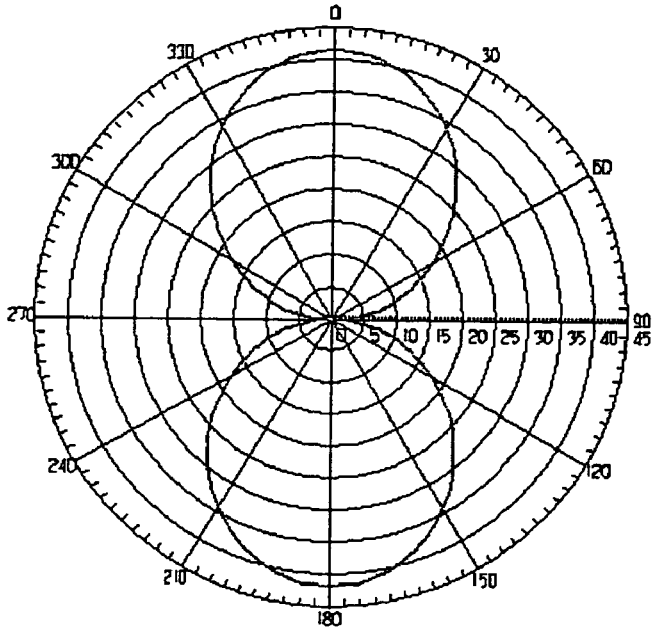
FIG. 10A is a graph of the frequency characteristic in the frequency at 3.1 GHz in Φ=0° of the embodiment of a printed antenna according to the present invention.
Figure 10B:
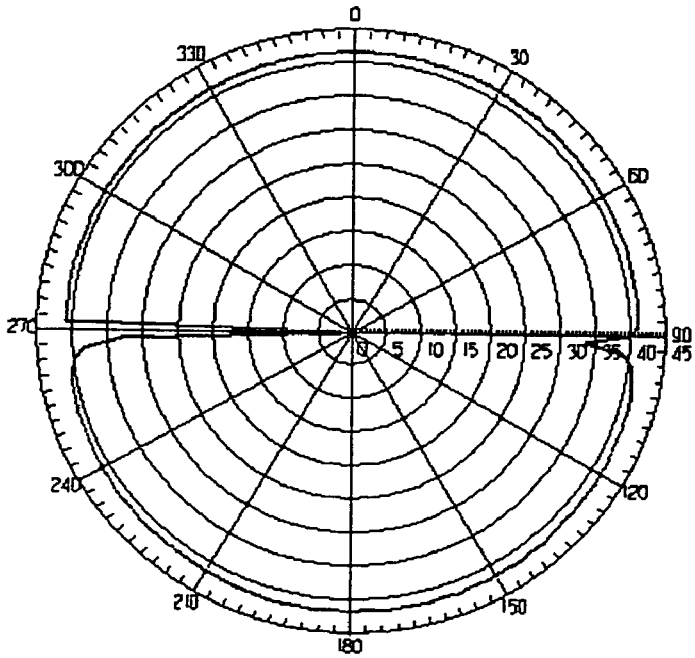
FIG. 10B is a graph of the frequency characteristic in the frequency at 3.1 GHz in Φ=90° of the embodiment of a printed antenna according to the present invention.
Figure 11A:
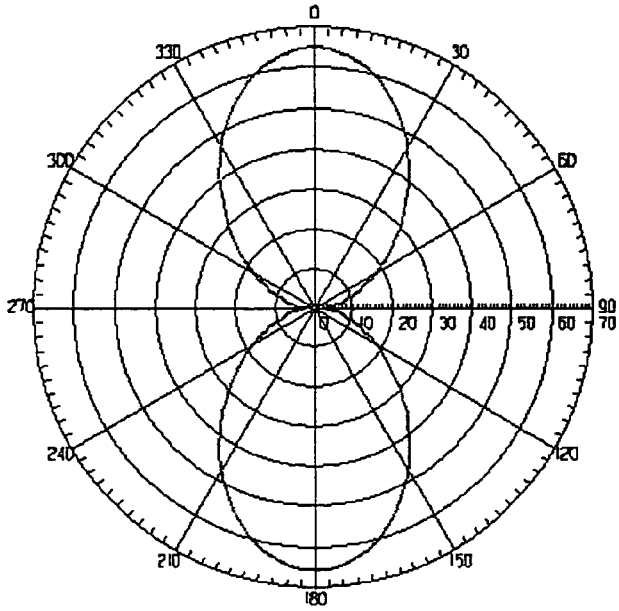
FIG. 11A is a graph of the frequency characteristic in the frequency at 5.1 GHz in Φ=0° of the embodiment of a printed antenna according to the present invention.
Figure 11B:
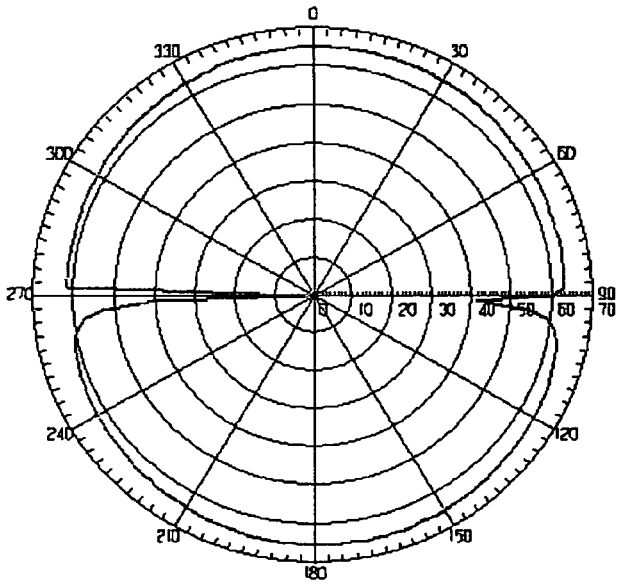
FIG. 11B is a graph of the frequency characteristic in the frequency at 5.1 GHz in Φ=90° of the embodiment of a printed antenna according to the present invention.
Figure 12A:
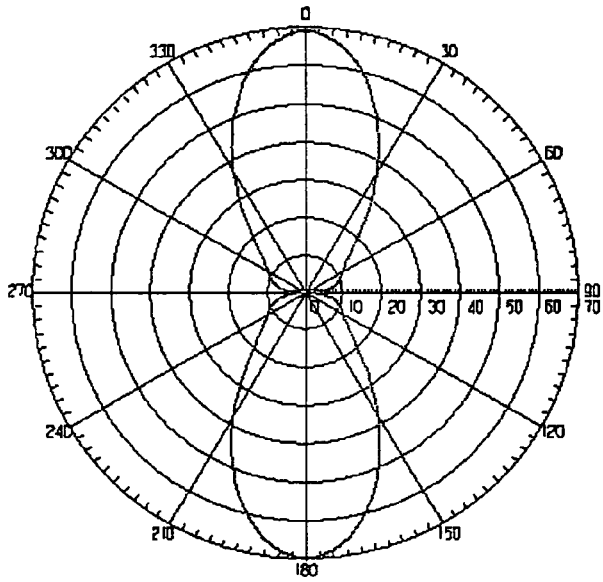
FIG. 12A is a graph of the frequency characteristic in the frequency at 7.1 GHz in Φ=0° of the embodiment of a printed antenna according to the present invention.
Figure 12B:
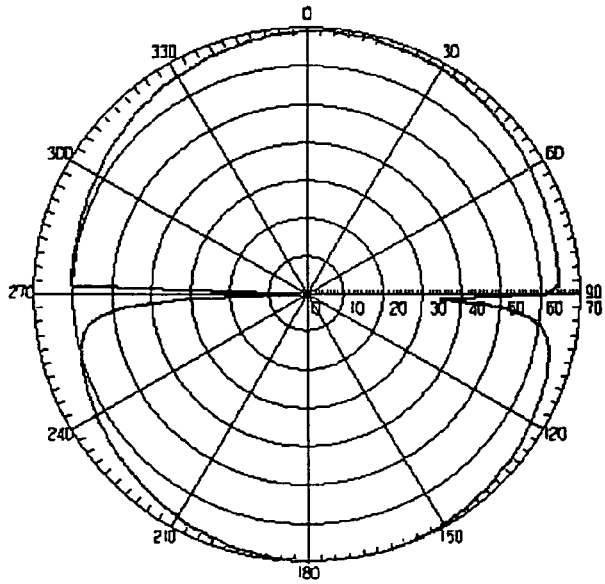
FIG. 12B is a graph of the frequency characteristic in the frequency at 7.1 GHz in Φ=90° of the embodiment of a printed antenna according to the present invention.
Figure 13A:
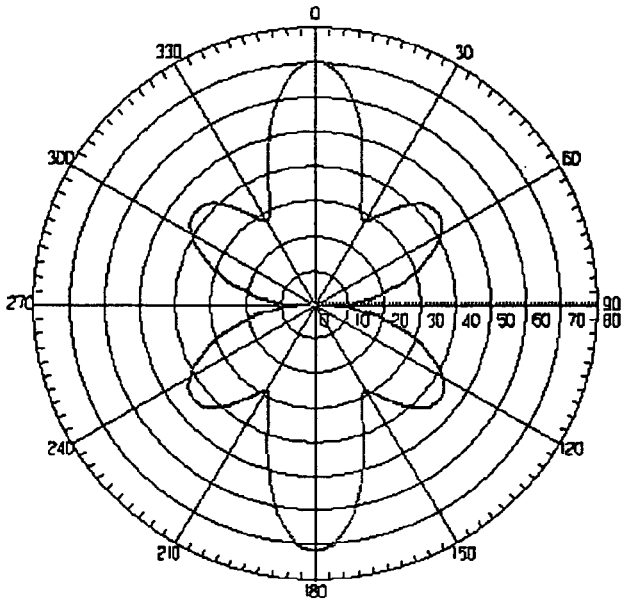
FIG. 13A is a graph of the frequency characteristic in the frequency at 9.1 GHz in Φ=0° of the embodiment of a printed antenna according to the present invention.

FIG. 10A through FIG. 13B show radiation patterns at frequency of 3.1 GHz–9.1 GHz to angle θ respectively in Φ=0° and Φ=90°, and in particular, FIG. 10A shows radiation patterns at frequency of 3.1 GHz in Φ=0°;

FIG. 10B shows radiation patterns at frequency of 3.1 GHz in Φ=90°;

FIG. 11A shows radiation patterns at frequency of 5.1 GHz in Φ=0°;

FIG. 11B shows radiation patterns at frequency of 5.1 GHz in Φ=90°;

FIG. 12A shows radiation patterns at frequency of 7.1 GHz in Φ=0°;

FIG. 12B shows radiation patterns at frequency of 7.1 GHz in Φ=90°;

FIG. 13A shows radiation patterns at frequency of 9.1 GHz in Φ=0°; and

Figure 13B:
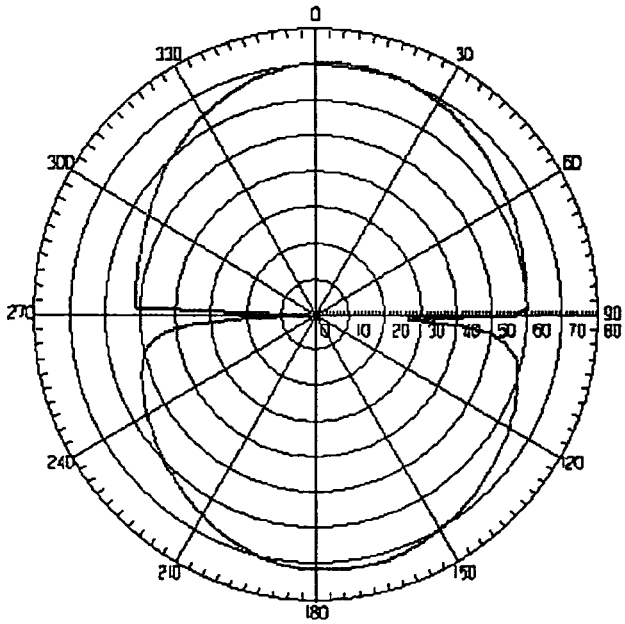
FIG. 13B is a graph of the frequency characteristic in the frequency at 9.1 GHz in Φ=90° of the embodiment of printed antenna according to the present invention.

FIG. 13B shows radiation patterns at frequency of 9.1 GHz in Φ=90°.

The radiation patterns in FIGS. 10A through 13B according to an embodiment of the present invention show characteristics of a dipole antenna. The radiation patterns are almost omni-directional.

According to preferred embodiments of the present invention, there is achieved a printed antenna having characteristics of small return loss and VSWR in the ultra wide range. Also the gain of the antenna is nearly constant in a wide range. Moreover, the characteristic impedance is almost constant and further the fluctuation is small in the frequency range.

According to preferred embodiments of the invention, the printed antenna has excellent radiation patterns of characteristic of dipole antenna in the ultra wide rage with an omni-directional patterns.

According to preferred embodiments of the invention, the printed antenna of the present invention is simple in structure, and further has a small profile, is light weight, easy to fabricate and is low in cost. Because of the excellent performance and attractive features of simplicity and small size, the present invention has great potential of wide use for ultra wide band communication devices.

The many features and advantages of the present invention are apparent from the detailed specification and, thus, it is intended by the appended claims to cover all such features and advantages of the invention which fall within the true spirit and scope of the invention. Further, since numerous modification and changes will readily occur to those skilled in the art, it is not desired to limit the invention to the exact construction and operation illustrated and described, and accordingly all suitable modification and equivalents falling within the scope of the invention may be included in the present invention.

What is claimed is:

1. A printed antenna having a dielectric substrate and a pair of printed antenna elements on the substrate comprising:

antenna elements being set separately and adjacently each other on a substrate;

an xy axis system being defined on an antenna plane so that the origin is defined at a center of location of the antenna elements, an x axis is set in a direction that the antenna elements are arranged, and a y axis is set in a direction perpendicular to the x axis;

a size of the antenna elements in the direction of the y axis becoming gradually larger according to the x axis changing in an outer direction; and each of the antenna elements comprising an impedance matching part at a feeding side of the antenna elements which is narrowed step by step from the antenna element side to the feeding side of the printed antenna, wherein the Voltage Standing Wave Ratio (VSWR) characteristic of the antenna is less than 3 in a frequency range of between 3.1 GHz to 10.6 GHz.

2. A printed antenna of claim 1, wherein the pair of antenna elements have a bow-tie type figure.

3. A printed antenna of claim 1, wherein each part of the ends of the antenna element of the most outside on the x axis is cut and parallel to the x axis.

4. A printed antenna of claim 1, wherein outer sides of the antenna elements perpendicular to the x axis are parallel to each other, and inner sides of the antenna elements perpendicular to the x axis are parallel to each other.

5. A printed antenna of claim 1, wherein the substrate comprises an insulating material and the printed pattern comprises a conducting material.

6. A printed antenna of claim 5, wherein the substrate comprises FR4.

7. A printed antenna of claim 5, wherein the printed pattern comprises Cu.

8. A component of a bow-tie shaped antenna, comprising:

a connection to an antenna element;

a connection to a feeding element;

a side, facing a gap in the antenna, having a continuously strait shape from the antenna element to the feeding element; and a side, facing away from the gap, having a plurality of steps causing the distance between the sides to decrease from the antenna element to the feeding element, wherein the Voltage Standing Wave Ratio (VSWR) characteristic of the antenna is less than 3 in a frequency range of between 3.1 GHz to 10.6 GHz.

9. An antenna comprising:

a substrate;

first and second antenna elements formed on the substrate to form a bow-tie shape;

a gap separating the first and second elements; and a section, electrically connecting the first element to a conductor, with a strait side facing the gap and with a stepped side facing away from the gap that tapers the section from the first element to a feeding sides, wherein the Voltage Standing Wave Ratio (VSWR) characteristic of the antenna is less than 3 in a frequency range of between 3.1 GHz to 10.6 GHz.

10. An antenna element comprising:

a first section forming part of a bow-tie type figure; and a second section which includes a side joining the first section, a continuously strait side, and a stepped side opposite the continuously strait side that narrows the second section from the first section to a feeding side, wherein the Voltage Standing Wave Ratio (VSWR) characteristic of the antenna element is less than 3 in a frequency range of between 3.1 GHz to 10.6 GHz.

* * * * *

UNITED STATES PATENT AND TRADEMARK OFFICE

CERTIFICATE OF CORRECTION

PATENT NO. : 7,123,207 B2
APPLICATION NO. : 10/925926
DATED : October 17, 2006
INVENTOR(S) : Kamya Yekeh Yazdandoost et al.

It is certified that error appears in the above-identified patent and that said Letters Patent is hereby corrected as shown below:

Column 8, Line 12, change “sides” to --side,--.

Signed and Sealed this

Eighth Day of May, 2007

JON W. DUDAS
*Director of the United States Patent and Trademark Office*